United States Patent [19]

Lavine et al.

[11] 4,115,906

[45] Sep. 26, 1978

[54] CLIPPABLE TROUSER RETAINING STRAP

[76] Inventors: Mortimore Lavine; Leanelda Lavine, both of 425 Randall Ave., Trenton, N.J. 08610

[21] Appl. No.: 820,905

[22] Filed: Aug. 1, 1977

[51] Int. Cl.[2] ..... A41F 17/04

[52] U.S. Cl. ..... 24/72; 2/233; 24/73 R; 24/81 GS

[58] Field of Search ..... 24/73 BE, 73 CH, 73 GS, 24/81 GS, 250, 72; 2/227, 236, 232, 232 A, 233, 189

[56] References Cited

U.S. PATENT DOCUMENTS

| | | | |
|---|---|---|---|
| 40,931 | 12/1863 | Heller | 24/72 |
| 43,727 | 8/1864 | Walker | 24/72 |
| 397,968 | 2/1889 | Carter | 24/72 |
| 610,967 | 9/1898 | Hill | 24/81 GS |
| 867,814 | 10/1907 | Fornander | 2/189 |
| 3,058,183 | 10/1962 | Hawie | 24/81 GS |
| 3,711,867 | 1/1973 | Mott | 2/230 |

FOREIGN PATENT DOCUMENTS

| | | | |
|---|---|---|---|
| 21,201 of | 1915 | United Kingdom | 24/72 |

*Primary Examiner*—Louis K. Rimrodt
*Attorney, Agent, or Firm*—Samuel Louis Sachs

[57] ABSTRACT

A clippable trouser retaining strap for maintaining a cuff of an unmodified leg of a pair of trousers worn by a user in a downward position including an elongated elastic member of adjustable length, a first locking clip disposed on one end of the elongated elastic member, and a second locking clip disposed on the other end of the elastic member. The elongated elastic member is positioned beneath the foot of the user and the first and second locking clips are secured to first and second portions of the cuff which are substantially opposite each other. The retaining strap is customarily used in pairs with one strap for retaining each trouser cuff in position.

2 Claims, 7 Drawing Figures

CLIPPABLE TROUSER RETAINING STRAP

BACKGROUND OF THE INVENTION

FIELD OF THE INVENTION

The present invention relates to apparatuses for maintaining the cuff of a trouser leg in a downward position, and more particularly, to a clippable trouser retaining strap for use with unmodified trousers.

DESCRIPTION OF THE PRIOR ART

A common inconvenience to active people is the unwarranted "hiking" or upward travel of trouser legs. For outdoor workers or those involved in winter sports, the hiking of trouser legs is uncomfortable because of exposure to nature's elements. In the case of bicycle riders, ice skaters, roller skaters, or those working outdoors on machinery, the hiking of trouser legs is not only uncomfortable but also may pose a safety hazard since a misplaced trouser cuff can easily cause jamming of a moving mechanism.

In an attempt to overcome the above problems, several apparatuses have been proposed in the prior art for holding down the cuffs of trouser legs. U.S. Pat. No. 43,727 issued to C. F. Walker on Aug. 2, 1864 discloses a pantaloon strap which is intended to keep the lower part of a pair of pantaloons over the top of the user's shoes to keep out snow and dirt. A pair of elements are provided on opposite ends of a cord. These elements have an arcuate cross section and are slid axially along the lower edge of the pantaloons to engage a stick disposed in the hem thereof. Each pair of pantaloons to which the strap of Walker is to be affixed must provide sticks or a similar longitudinal element disposed in the hem thereof.

U.S. Pat. No. 3,177,498 issued to J. D. Sadowski on Apr. 13, 1965 discloses stays for trousers which comprise a strap having a flexible elongated cross piece affixed to each end thereof. Two pairs of slits are disposed in the cuff portion of a pair of trousers to removeably accept the flexible elongated cross pieces. As in Walker, each pair of trousers with which the apparatus of Sadowski is used, must be specially constructed.

U.S. Pat. No. 3,200,414 issued to S. Sternberg on Aug. 17, 1965 discloses a detachable stirrup for womens slacks and stretch pants which is similar to that of Sadowski except that the structure of Sternberg includes a pair of Velcro patches to insure affixment of the strap thereof to the slacks. As in Walker and Sadowski, the stirrups of Sternberg may only be used in conjunction with specifically modified or manufactured slacks.

U.S. Pat. No. 3,209,370 issued to M. G. Miller on Oct. 5, 1965 discloses an adjustable stirrup for stretch pants which provides a strap having a U-shaped clip disposed on both ends thereof. The U-shaped clips are designed to engage a pair of loops which are sewn to the inner surfaces of the pants. As in the above discussed patents, the stirrups of Miller may only be used with specially constructed pants, i.e., those which have loops affixed thereto.

U.S. Pat. No. 2,670,474 issued to E. C. Schultz on Mar. 2, 1954 discloses a hold down device for pajama trouser legs and the like which includes a web that wraps around the ankle, instep, and arch of the user. A strap is affixed on one end thereof to the web adjacent to the instep of the user with a releaseable clip secured to the other end of the strap. The web of Schultz unnecessarily constricts movement of the foot of the user and only secures the trouser leg at one point, adjacent to the instep of the user. Resultantly, the rear of the trouser leg can still hike up.

U.S. Pat. No. 2,687,531 issued to A. E. Frechette on Aug. 31, 1954 discloses pajamas which, in one embodiment, include a loop of material bearing a clasp slideable thereon. When the stirrup of Frechette is used, the clasp merely contacts the trouser leg at one point thereby incurring a similar problem as in Schultz. Furthermore, when the foot of the user is placed through the loop an uncomfortable cross-pulling effect is manifested since one leg of the loop must pull across the instep of the user.

The present invention overcomes the problems associated with the prior art by providing a clippable trouser retaining strap which may be affixed to any type of trousers without modification, which may be adjusted for different styles and lengths of trousers, and which may be comfortably worn by the user without undue restriction or uncomfortable engagement of his foot.

SUMMARY OF THE INVENTION

Therefore, a primary object of the present invention is to provide a clippable trouser retaining strap for maintaining a cuff of an unmodified leg of a pair of trousers worn by a user in a downward position.

A further object of the present invention is to provide a clippable trouser retaining strap which engages the cuff of a trouser at two points to insure effective retention.

A still further object of the present invention is to provide a clippable trouser retaining strap which may be used with any type, size, or style of trousers without any modification whatsoever to the trousers.

Still another object of the present invention is to provide a clippable trouser retaining strap which may be easily and quickly placed into a use position around the foot of a user.

Still another further object of the present invention is to provide a clippable trouser retaining strap which may be worn comfortably against the bare or stocking foot of the user.

Another further object of the present invention is to provide a clippable trouser retaining strap which may be worn over the shoe of a user.

Another still further object of the present invention is to provide a clippable trouser retaining strap which is ideally suited for use by sportsmen, outdoor workers, and the like.

Another object of the present invention is to provide a clippable trouser retaining strap which simple in design, inexpensive to manufacture, rugged in construction, easy to use, and efficient in operation.

These objects, as well as further objects and advantages, of the present invention will become readily apparent after reading the description of a non-limiting illustrative embodiment and the accompanying drawing.

A clippable trouser retaining strap for maintaining a cuff of an unmodified trouser leg of a user in a downward position according to the principles of the present invention includes an elongated elastic member of adjustable length, the elongated elastic member for placement beneath the foot of the user; a first locking clip secured to one end of the elongated elastic member, the clip for engaging a first portion of the cuff, the first clip being selectively securable to the first portion; and a second locking clip secured to the elongated elastic member adjacent to the other end thereof, the second locking clip for engaging a second portion of the cuff, the second clip being selectively securable to the second portion, the first and second portions of the cuff being substantially opposite each other.

BRIEF DESCRIPTION OF THE DRAWING

In order that the present invention may be more fully understood it will now be described, by way of example, with reference to the accompanying drawing in which.

DESCRIPTION OF THE PREFERRED EMBODIMENT

Figure 1:
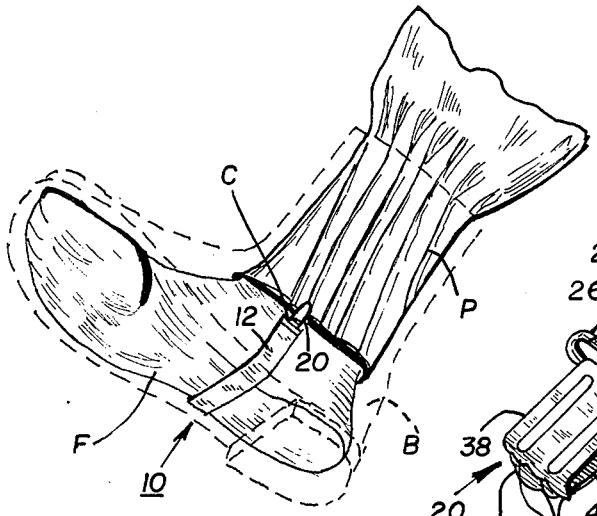
FIG. 1 is a pictorial representation of the preferred embodiment in use.
Figure 2:
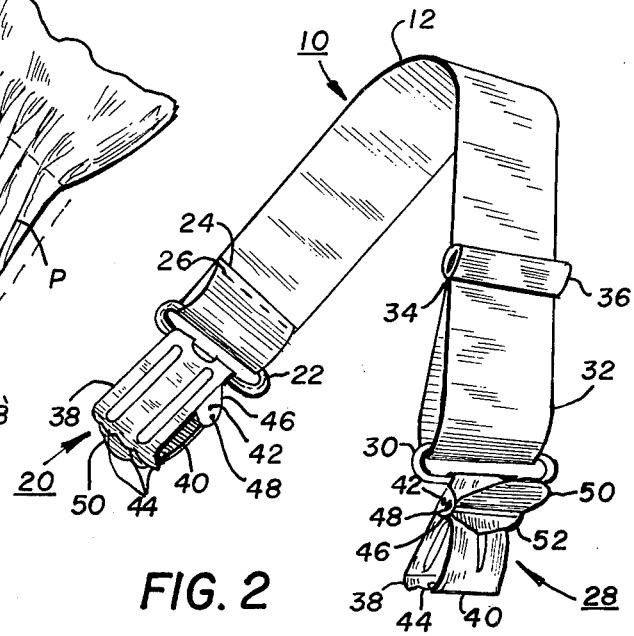
FIG. 2 is a an enlarged pictorial representation of the preferred embodiment.
Figure 3:
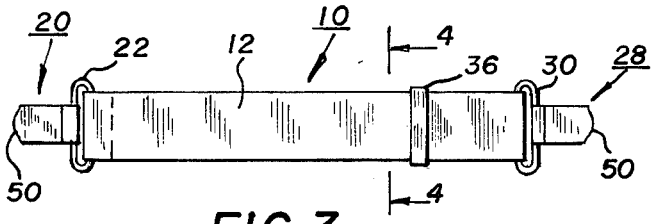
FIG. 3 is a top view of the preferred embodiment.

Referring now to the figures, and more particularly to FIGS. 1, 2, 3, and 4 thereof, there is illustrated therein a clippable trouser retaining strap 10. With particular reference to FIG. 1, the clippable trouser retaining strap 10 is employed to keep a pants leg P within a boot B. The retaining strap 10 is clipped to the cuff C of the pants leg P and passes under the foot F of the user.

Figure 4:
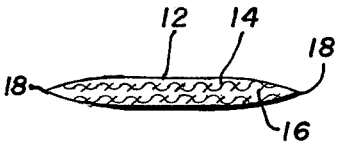
FIG. 4 is cross-sectional view of the preferred embodiment taken substantially along the lines 4—4 of FIG. 3.

The clippable trouser retaining strap 10 includes an elongated elastic member 12 which is adjustable in length. The elongated elastic member 12 is elastic in the direction of the longitudinal axis thereof and may be constructed of a plurality of strands of rubber 14 woven together by a suitable cloth material 16. Referring specifically to FIG. 4, the elongated elastic member 12 is tapered toward the edges 18 thereof to provide comfort for the user when the elastic member 12 rests adjacent to his foot F.

A first locking clip 20 provides an elongated ring 22. A portion of the elongated elastic member 12 adjacent to the first end 24 thereof is passed through the elongated ring 22 and is stitched by stitches 26 to the elastic member 12 thereby securing the first locking clip 20 thereto.

A second locking clip 28 providing an elongated ring 30 is moveably secured to the elongated elastic member 12 by a portion 32 of the elongated elastic member 12 which passes through the elongated ring 30. The second end 34 of the elongated elastic member 12 is fixedly secured to a clamp 36 that is moveably positionable along the elastic member 12. The clamp 36 may be of any suitable compression type clamp so long as it may be locked into position along the length of the elastic member. It should be apparent that the closer the clamp 36 is to the first locking clip 20, the shorter the length will be of the elastic member 12.

The first and second locking clips 20 and 28 each include a pair of jaws 38 and 40 which are pivotally affixed together by a pin 42. The jaws 38 and 40 are provided with a plurality of teeth 44 to enhance engagement of the cuff C when placed therebetween. A bracket 46 is fixedly secured to each of the jaws 38 and provides a pair of aligned apertures 48 therein. A clamp element 50 having a tongue 52 extending therefrom is provided by each of the clips 20 and 28. Each of the clamp elements 50 is pivotally affixed to one of the brackets 46 by protrusions which extend through the aligned apertures 48. When the clamp element 50 is urged toward the jaws 38 and 40, the tongue 52 thereof presses against an indentation in the jaw 40 thereby urging the jaws 38 and 40 together. If the clamp element 50 is pressed until it is substantially parallel to the jaws 38 and 40, pressure of the tongue 52 against the indentation in the jaw 40 will lock the jaws 38 and 40 together.

Figure 6:
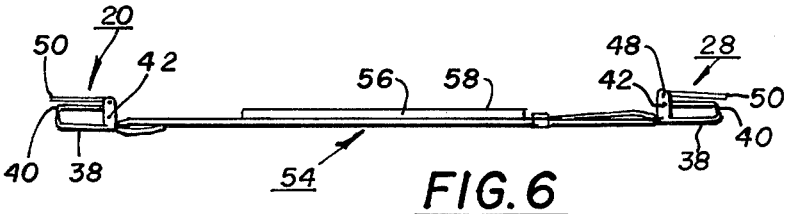
FIG. 6 is a side view of the alternate embodiment of FIG. 5.
Figure 7:
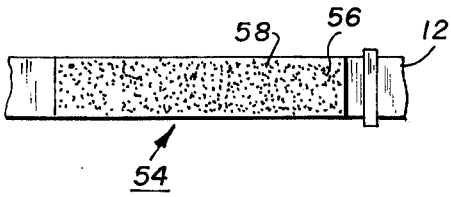
FIG. 7 is fragmentary top view of the alternate embodiment of FIG. 5.
Figure 5:
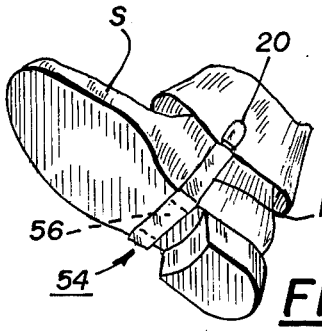
FIG. 5 is a pictorial representation of an alternate embodiment of the present invention in use.

Referring to FIGS. 5, 6, and 7 there is illustrated therein an alternate embodiment of the clippable trouser retaining strap 10, a clippable trouser retaining strap 54. All the elements of the retaining strap 54 are identical to the elements of the retaining strap 10 with the exception of the addition of a semi-resilient pad 56. The semi-resilient pad 56 may be constructed of rubber or the like and provides a friction inducing surface 58. The semi-resilient pad 56 is fixedly secured to the strap 54 by suitable means and is provided so that when the clippable trouser strap 54 is used on the outside of shoe S as illustrated in FIG. 5, the semi-resilient pad 56 will engage the bottom of the shoe S to preclude slippage of the retaining strap 54 thereon. The use of the pad 56 is particularly helpful with smooth soled shoes.

In use, the clippable trouser retaining strap 10 is clipped by the first locking clip 20 thereof to the edge of the cuff C of the pants leg P. The elongated elastic member 12 is then passed underneath the foot F of the user and the clamp 36 is adjusted so that the elongated elastic member 12 is the proper length. The second locking clip 28 is then secured to the second edge of the cuff C in a position opposite that of the first locking clip 20. After the pants leg P is secured by the first and second locking clips 20 and 28, the user may put his boot B on his foot F. It should be apparent that the clippable trouser retaining strap 10 will securely and firmly retain the cuff C of the pants leg P within the boot B of the user. If the user desires, the clippable trouser retaining strap 54 may be placed around the outside of his shoes as illustrated in FIG. 5. This might be the case wherein the user is wearing dress shoes which are then covered with rubber boots, galoshes, or the like.

Therefore, a primary advantage of the present invention is to provide a clippable trouser retaining strap for maintaining a cuff of an unmodified leg of a pair of trousers worn by a user in a downward position.

A further advantage of the present invention is to provide a clippable trouser retaining strap which engages the cuff of a trouser at two points to insure effective retention.

A still further advantage of the present invention is to provide a clippable trouser retaining strap which may be used with any type, size, or style of trousers without any modification whatsoever to the trousers.

Still another advantage of the present invention is to provide a clippable trouser retaining strap which may be easily and quickly placed into a use position around the foot of a user.

Still another further advantage of the present invention is to provide a clippable trouser retaining strap which may be worn comfortably against the bare or stocking foot of the user.

Another further advantage of the present invention is to provide a clippable trouser retaining strap which may be worn over the shoe of a user.

Another still further advantage of the present invention is to provide a clippable trouser retaining strap which is ideally suited for use by sportsmen, outdoor workers, and the like.

Another advantage of the present invention is to provide a clippable trouser retaining strap which is simple in design, inexpensive to manufacture, rugged in construction, easy to use, and efficient in operation.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A clippable trouser retaining strap for maintaining a cuff of an unmodified trouser leg of a user in a downward position comprising:

an elongated elastic member of adjustable length, said elongated elastic member for placement beneath the foot of the user, said elongated elastic member being elastic in a direction along the longitudinal axis thereof, said elongated elastic member being tapered from the longitudinal axis thereof to the longitudinal edges thereof, said edges being thinner than the portion of said elastic member adjacent to the longitudinal axis thereof;

a first locking clip secured to one end of said elongated elastic member, said clip for engaging a first portion of said cuff, said first clip being selectively securable to said first portion;

a second locking clip secured to said elongated elastic member adjacent to the other end thereof, said second locking clip for engaging a second portion of said cuff, said second clip being selectively securable to said second portion, said first and second portions of said cuff being substantially opposite each other;

a locking clamp for adjusting the length of said elongated elastic member, said locking clamp fixedly secured to said other end of said elastic member, an elongated ring being provided by said second locking clip, a portion of said elongated elastic member adjacent to said other end thereof passing through said elongated ring and being positioned adjacent to said elastic member, said clamp being selectively clampable to said elastic member, the positioning of said clamp on said elongated elastic member adjusting the length thereof; and said first and second locking clips each including a pair of jaws pivotally affixed together, and a clamp element having a tongue projecting therefrom, a bracket fixedly secured to one of said jaws, said clamp element pivotally mounted by said bracket adjacent to the juncture of said tongue thereof, each of said jaws providing a plurality of teeth for engaging said cuff, urging of said clamp element toward said pair of jaws causing said tongue to engage the other of said jaws thereby effecting the locking of said jaws together.

2. A clippable trouser retaining strap in accordance with claim 1, further comprising a semi-resilient pad fixedly secured to a surface of said elongated elastic member adjacent to said foot of the user when the strap is in use, said semi-resilient pad having a friction inducing surface.

* * * * *